US010072669B2

(12) United States Patent
Shen et al.

(10) Patent No.: US 10,072,669 B2
(45) Date of Patent: Sep. 11, 2018

(54) CENTRIFUGAL IMPELLER FOR A BLOWER

(71) Applicant: Johnson Electric S.A., Murten (CH)

(72) Inventors: Jun Feng Shen, Shenzhen (CN); Ching Hang Leung, Hong Kong (CN); Siu Chun Tam, Hong Kong (CN)

(73) Assignee: Johnson Electric S.A., Murten (CH)

( * ) Notice: Subject to any disclaimer, the term of this patent is extended or adjusted under 35 U.S.C. 154(b) by 719 days.

(21) Appl. No.: 14/604,190

(22) Filed: Jan. 23, 2015

(65) Prior Publication Data

US 2015/0204344 A1 Jul. 23, 2015

(30) Foreign Application Priority Data

Jan. 23, 2014 (CN) ..... 2014 1 0033397

(51) Int. Cl.
*F04D 29/28* (2006.01)
*F04D 17/08* (2006.01)
*F04D 29/62* (2006.01)

(52) U.S. Cl.
CPC ..... *F04D 29/281* (2013.01); *F04D 17/08* (2013.01); *F04D 29/626* (2013.01)

(58) Field of Classification Search
CPC ..... F04D 17/08; F04D 29/22; F04D 29/2222; F04D 29/28; F04D 29/281; F04D 29/282; F04D 29/283; F04D 29/30
See application file for complete search history.

(56) References Cited

U.S. PATENT DOCUMENTS 3,225,422 A * 12/1965 Sebok ..... B21D 53/267 29/463
5,755,555 A * 5/1998 Swift ..... F04D 17/164 415/206
5,984,632 A * 11/1999 Lee ..... A47L 5/22 403/263
6,156,090 A * 12/2000 Ishikawa ..... F04D 29/30 416/144
6,592,329 B1 * 7/2003 Hirose ..... F04D 29/023 416/203

FOREIGN PATENT DOCUMENTS

JP H08319991 12/1996

* cited by examiner

*Primary Examiner* — Kenneth Bomberg
*Assistant Examiner* — Julian Getachew
(74) *Attorney, Agent, or Firm* — Muncy, Geissler, Olds & Lowe, P.C.

(57) ABSTRACT

A centrifugal impeller for a blower has a base plate, a cover plate, and a plurality of curved blades mounted between the base plate and the cover plate. The base plate and the cover plate have blade mounting portions including a plurality of mounting holes. Cover plate mounting portions and base plate mounting portions project from each blade and engage with the mounting holes of the cover plate and base plate, respectively. The mounting holes of the cover plate include first mounting holes arranged outwardly from a central region. The first mounting holes have a circular shape. The cover plate mounting portions of each blade include first mounting protrusions engaged with the first mounting holes.

11 Claims, 6 Drawing Sheets

CENTRIFUGAL IMPELLER FOR A BLOWER

CROSS REFERENCE TO RELATED APPLICATIONS

This non-provisional patent application claims priority under 35 U.S.C. § 119(a) from Patent Application No. 201410033397.4 filed in The People's Republic of China on Jan. 23, 2014, the entire contents of which are hereby incorporated by reference.

FIELD OF THE INVENTION

This invention relates to a blower and in particular, to a centrifugal impeller of the blower. It also relates to electrical appliances, such as a vacuum cleaner or a hand drier, that use the blower.

BACKGROUND OF THE INVENTION

As a main component of a hand drier, a blower comprises a centrifugal impeller and a motor for driving the impeller. The impeller moves air to form a pressurized airflow that is discharged via an air outlet. A hand drier and a vacuum cleaner typically employ a centrifugal blower with a central air inlet and a peripheral air outlet.

Referring to FIG. 1, a conventional centrifugal impeller has a base plate 10, a cover plate 20, and a blade assembly 30 arranged between the base plate 10 and the cover plate 20. A motor shaft mounting hole 101 is formed at a central position of the base plate 10. An air inlet 201 is formed at a central position of the cover plate 20. The blade assembly 30 includes a plurality of curved blades 301 arranged annularly. Cover plate mounting portion 302 and base plate mounting portion (not shown) extent outwardly from a top side (close to the cover plate) and a bottom side (close to the base plate) of each curved blade 301, respectively. The cover plate 10 and the base plate 20 have rectangular blade mounting holes 202 and blade mounting holes (not shown) corresponding to the cover plate mounting portions 302 and base plate mounting portions (not shown), respectively.

One drawback of the conventional blower is that, when the motor speed is high, especially higher than 33000 RPM, it is known for the centrifugal impeller to break. Basically, cracks occur in the cover plate, spreading out from the blade mounting holes 202 close to the air inlet 201. The cracks lead to the failure of the centrifugal impeller, reducing the lifespan of the blower.

SUMMARY OF THE INVENTION

Thus there is a desire for a centrifugal impeller with a prolonged lifespan.

Accordingly, in one aspect thereof, the present invention provides a centrifugal impeller comprising: a base plate comprising a plurality of blade mounting portions, each of the blade mounting portions having a plurality of blade mounting holes; a cover plate defining an air inlet, the cover plate and the base plate disposed opposite to each other with a predetermined distance formed there between, the cover plate comprising a plurality of blade mounting portions; and a blade assembly fixedly mounted between the base plate and the cover plate, the blade assembly comprising a plurality of curved blades arranged about the air inlet, each blade being fixed between a corresponding one of the blade mounting portions of the base plate and a corresponding one of the blade mounting portions of the cover plate, each blade having a first side close to the cover plate and a second side close to the base plate, cover plate mounting portions projecting from the first side and base plate mounting portions projecting from the second side; wherein each of the blade mounting portions of the cover plate comprises a plurality of first mounting holes arranged outwardly from a region close to the air inlet, the first mounting holes having one of a regular polygon shape, elliptical shape and circular shape, and the cover plate mounting portions of each blade comprise a plurality of first mounting protrusions engaged with the plurality of first mounting holes.

Preferably, the first mounting protrusions are round or square in shape.

Preferably, each blade mounting portion of the cover plate further comprises at least one second mounting hole arranged inwardly from a region close to an outer edge of the cover plate, the second mounting hole having a rectangular shape, the cover plate mounting portions of each blade further comprise at least one second mounting protrusion for engaging with the at least one second mounting hole.

Preferably, each second mounting protrusion is rectangular in shape, with a recess formed in a middle of an outer side of the rectangle.

Preferably, the number of first mounting protrusions of the cover plate mounting portions of each blade is three to ten times the number of the at least one second mounting protrusion.

Preferably, for the cover plate mounting portions of each blade, a sum of the number of first mounting protrusions and the number of the at least one second mounting protrusion is at least ten.

Preferably, the base plate mounting portions of each blade comprise a plurality of mounting protrusions and each mounting protrusion is rectangular in shape, with a recess formed in a middle of an outer side of the rectangle.

Preferably, the blade mounting hole of the base plate has a rectangular shape.

Preferably, the number of blade mounting holes of each blade mounting portion of the base plate is less than the number of first mounting holes of each blade mounting portion of the cover plate.

According to a second aspect, the present invention provides a blower comprising a motor, and the above centrifugal impeller, driven by the motor.

According to a third aspect, the present invention provides an electrical appliance comprising: an outer housing with an inlet opening and an outlet opening, and a blower, as described above, mounted within the outer housing.

Preferably, the appliance is a hand drier or a vacuum cleaner.

In embodiments of the present invention, the blade mounting holes of the cover plate close to the air inlet are configured to have a circular shape or a regular polygon shape, which reduces or even eliminates stress concentration at the blade mounting holes of the cover plate and thus increases the strength of the cover plate. This effectively avoids the failure of the centrifugal impeller due to stress cracking under high speed rotation of the impeller, greatly prolonging the lifespan of the blower.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
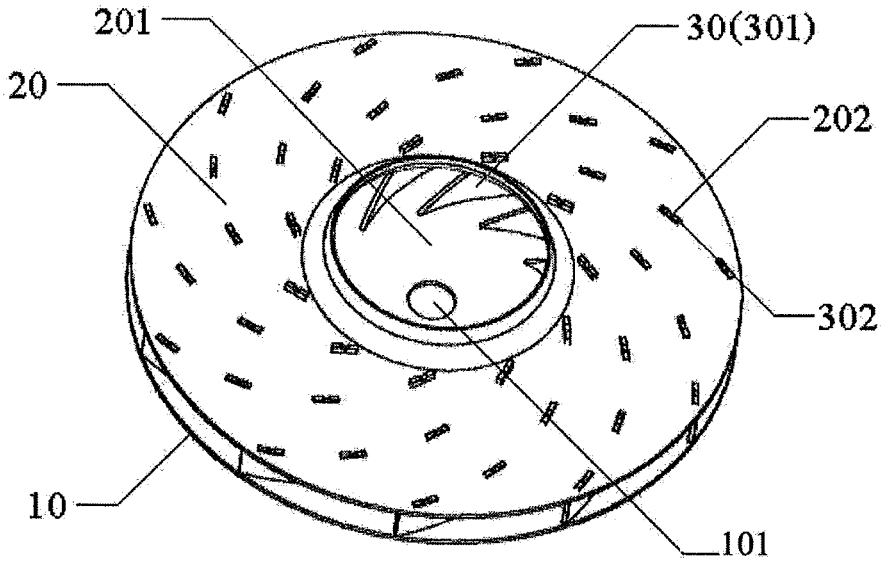
FIG. 1 (Prior Art)
FIG. 1 is a perspective view of a conventional centrifugal impeller for use in a blower.
Figure 2:
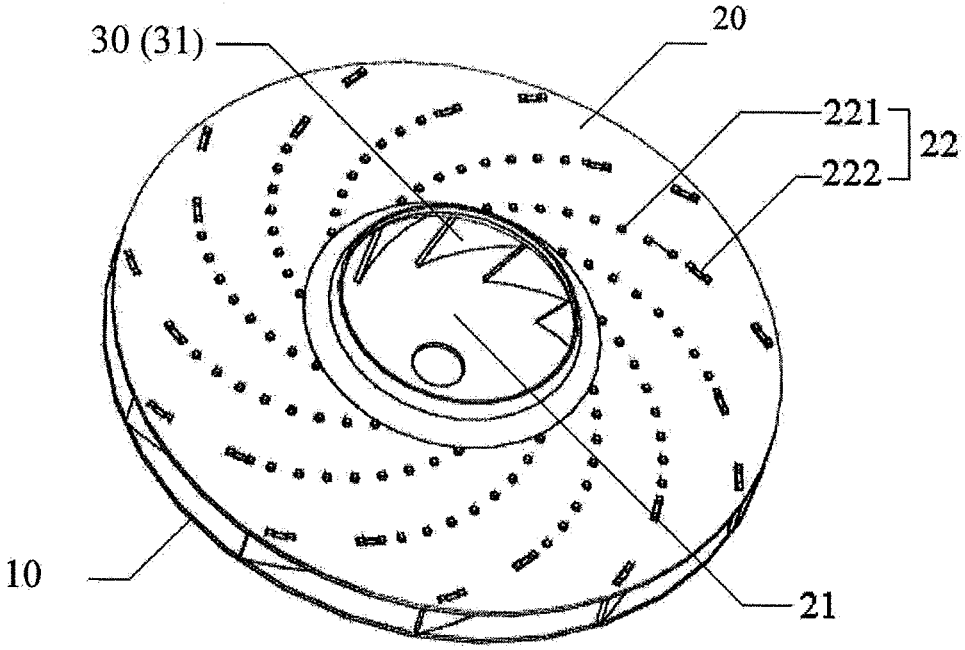
FIG. 2 is a perspective view of a centrifugal impeller with increased strength according to a first embodiment of the present invention.
Figure 3:
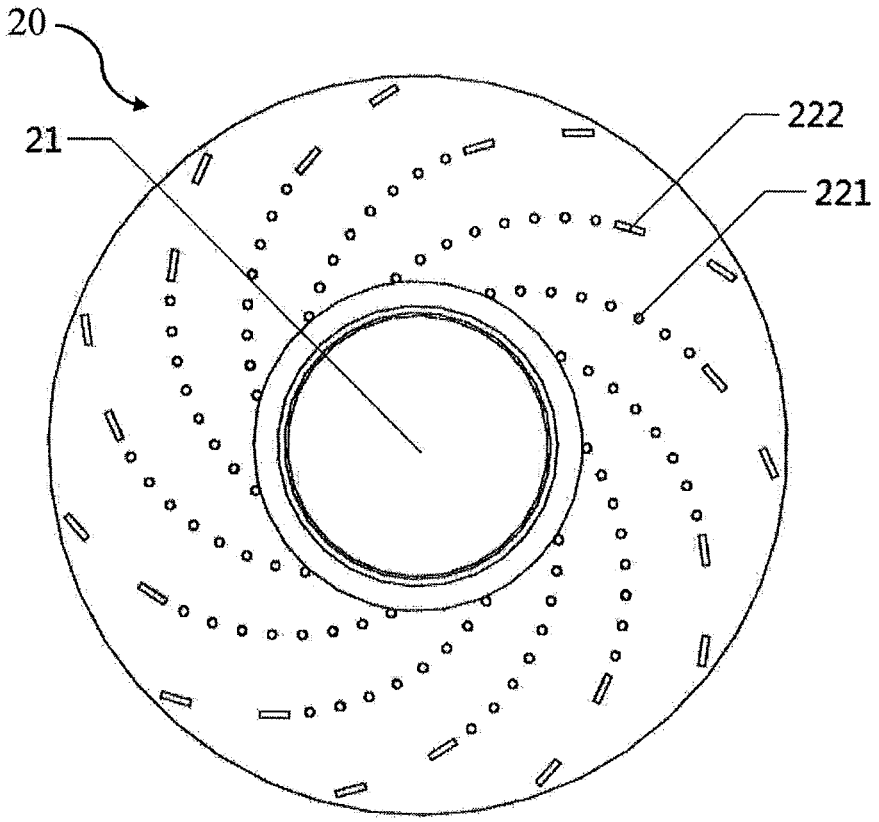
FIG. 3 is a plan view of a cover plate of the impeller of FIG. 2.
Figure 4:
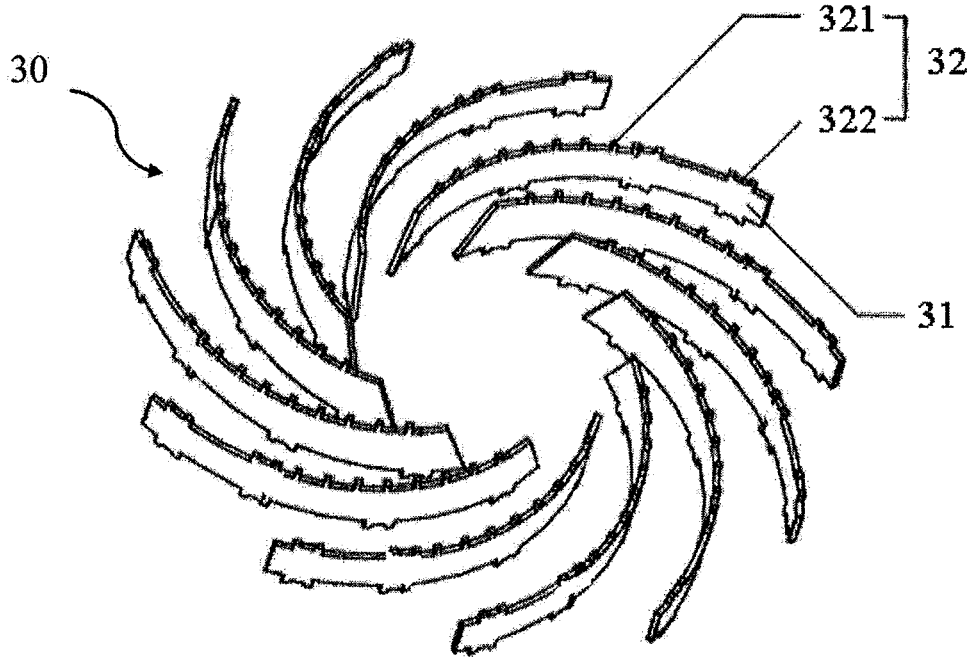
FIG. 4 illustrates a blade assembly of the impeller of FIG. 2.
Figure 5:
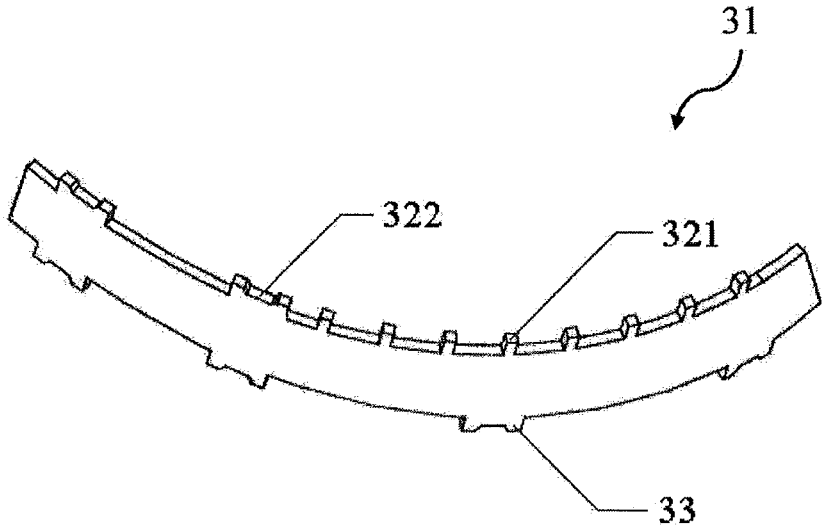
FIG. 5 illustrates a single blade of the blade assembly of FIG. 4.
Figure 6:
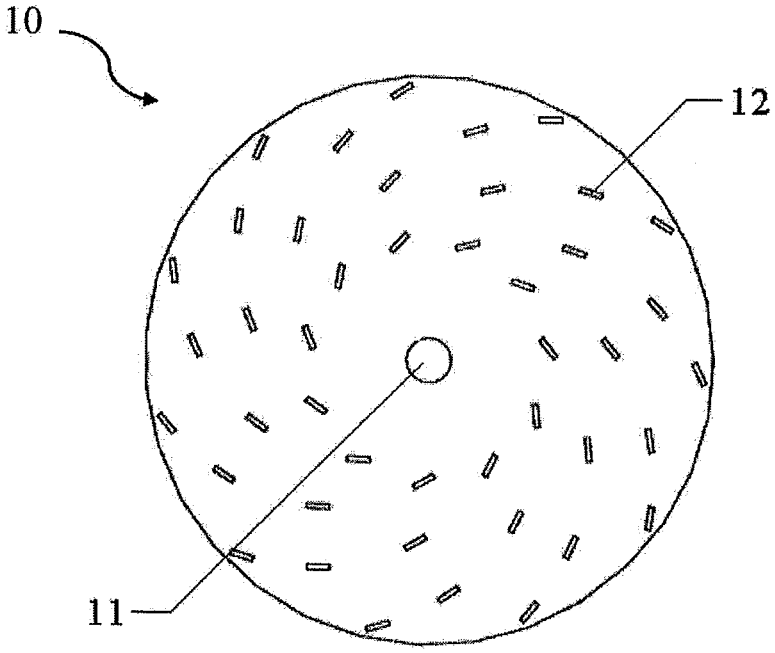
FIG. 6 is a plan view of a base plate of the impeller of FIG. 2.
Figure 7:
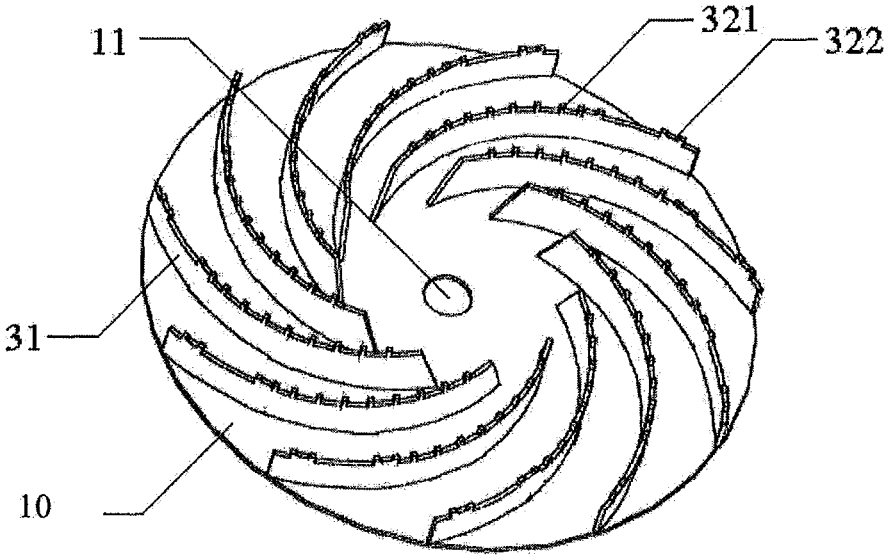
FIG. 7 illustrates the blade assembly of FIG. 4 mounted on the base plate of FIG. 6.

A centrifugal impeller in accordance with one embodiment of the present invention is described below with reference to FIGS. 2 to 7. The centrifugal impeller has a base plate 10, a cover plate 20, and a blade assembly 30 arranged between the base plate 10 and the cover plate 20. The cover plate 20 forms an air inlet 21 at a central position of the cover plate 20.

Preferably, the base plate 10, the cover plate 20 and the blade assembly 30 are all fabricated from a metal material, ideally an aluminum material.

The blade assembly 30 includes a plurality of curved blades 31 arranged annularly around the air inlet 21. The base plate 10 includes a plurality of blade mounting portions. Each blade mounting portion extends outwardly along a helical line for mounting one corresponding blade 31. Similarly, the cover plate 20 also includes a plurality of blade mounting portions. Each blade mounting portion of the cover plate 20 extends outwardly along a helical line for mounting one corresponding blade 31.

Specifically, a plurality of cover plate mounting portions 32 and a plurality of base plate mounting portions 33 project from a top side (close to the cover plate) and a bottom side (close to the base plate) of each curved blade 31. Each blade mounting portion of the cover plate 20 and each blade mounting portion of the base plate 10 have corresponding blade mounting holes 22 and blade mounting holes 12, respectively. Preferably, rivet connections are used to mount the blades 31 to the base plate 10 and the cover plate 20 by deforming the mounting portions 32, 33.

In the present embodiment, each blade mounting portion of the cover plate 20 includes a plurality of first mounting holes 221 and a plurality of second mounting holes 222. The first mounting holes 221 are circular and arranged outwardly from the air inlet 21. The second mounting holes 222 are rectangular and distributed in regions adjacent an outer peripheral edge of the cover plate. The cover plate mounting portions 32 of each blade include a plurality of first mounting protrusions 321 that engage with the first mounting holes 221 and a plurality of second mounting protrusions 322 that engage with the second mounting holes 222.

The first mounting holes 221 of the cover plate 20 are circular, which eliminates the stress concentration that occurs at corners of the conventional rectangular holes. This increases the strength of the cover plate 20, thus making it not easy to be damaged and prolonging the lifespan of the centrifugal impeller. It is to be understood that the first mounting holes 221 may also be of a regular polygon shape, such as, a square shape or elliptical, to reduce the stress concentration.

In the present embodiment, each blade mounting portion of the cover plate 20 has ten mounting holes, the number of first mounting holes 221 is eight and the number of second mounting holes 222 is two. Correspondingly, the cover plate mounting portions 32 on the top side of the each curved blade 31 has ten mounting protrusions, the number of the first mounting protrusions is eight and the number of the second mounting protrusions is two. It is to be understood that the number of the first mounting holes 221 and second mounting holes 222 of each blade mounting portion may be another value. Preferably, the number of first mounting holes 221 of each blade mounting portion is three to ten times the number of second mounting holes 222. Correspondingly, the number of first mounting protrusions of the cover plate mounting portions of each blade is three to ten times the number of second mounting protrusions.

Preferably, the size and shape of the first mounting protrusions 321 corresponds with the size and shape of the first mounting holes 221. For example, the first mounting protrusion 321 may be of a round or square structure. The second mounting protrusion 322 is rectangular in shape, with a recess formed in the middle of an outer side of the rectangle. During the riveting process, after the first mounting protrusions 321 pass through the first mounting holes 221 and the second mounting protrusions 322 pass through the second mounting holes 222, the first mounting protrusions 321 and the ends of the second mounting protrusions are deformed to lock the blades to the cover plate 20.

The blade mounting holes 12 of the base plate 10 are rectangular in shape. The base plate mounting portions 33 of the blades 31 comprise protrusions that are rectangular in shape, with a recess formed in the middle of the outer side of the rectangle. During the riveting process, the ends of the protrusions of the base plate mounting portions 33 are deformed to lock the blade to the base plate 20.

Optionally, the number of the base plate mounting portions 33 on the bottom side of each curved blade 31 and the corresponding blade mounting holes 12 may be four. That is, the number of mounting protrusions of the cover plate mounting portions 32 of each curved blade 31 is greater than the number of protrusions of the base plate mounting portions 33.

In comparison with the conventional impeller, the blade mounting holes (i.e. the first mounting holes) of the cover plate close to the air inlet is configured to have a circular shape, elliptical shape or a regular polygon shape and the number of the blade mounting holes is increased in the present invention. This effectively avoids the centrifugal impeller breaking due to high speed rotation by the motor, greatly prolonging the lifespan of the blower.

Figure 8:
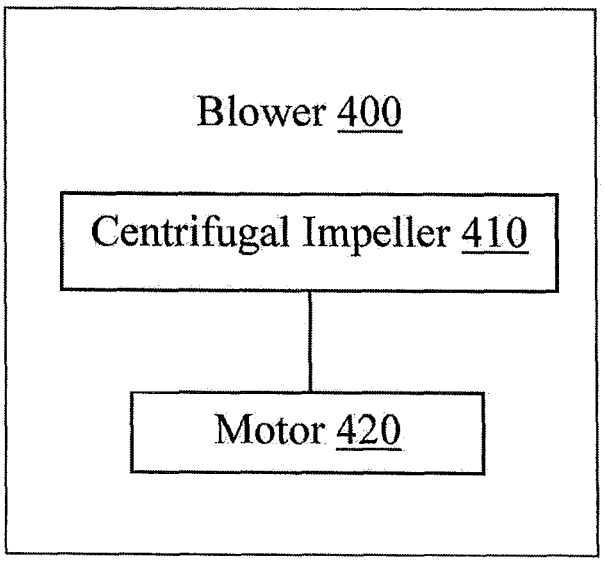
FIG. 8 is a schematic representation of a blower for use in an electrical appliance such as a hand drier.

FIG. 8 is a schematic representation of a blower 400 according to another embodiment of the present invention, which is suitable for an electrical appliance such as a hand drier or a vacuum cleaner. The blower has a centrifugal impeller 410 as described above and an electric motor 420 for driving the centrifugal impeller 410. The blower is mounted within an outer housing of the appliance. The outer housing has an inlet opening and an outlet opening. During operation of the blower, the motor 420 rotates the centrifugal impeller 410 to establish an air flow.

The blower provided by the present invention can be used as the blower of a hand drier or a vacuum cleaner.

Figure 9:
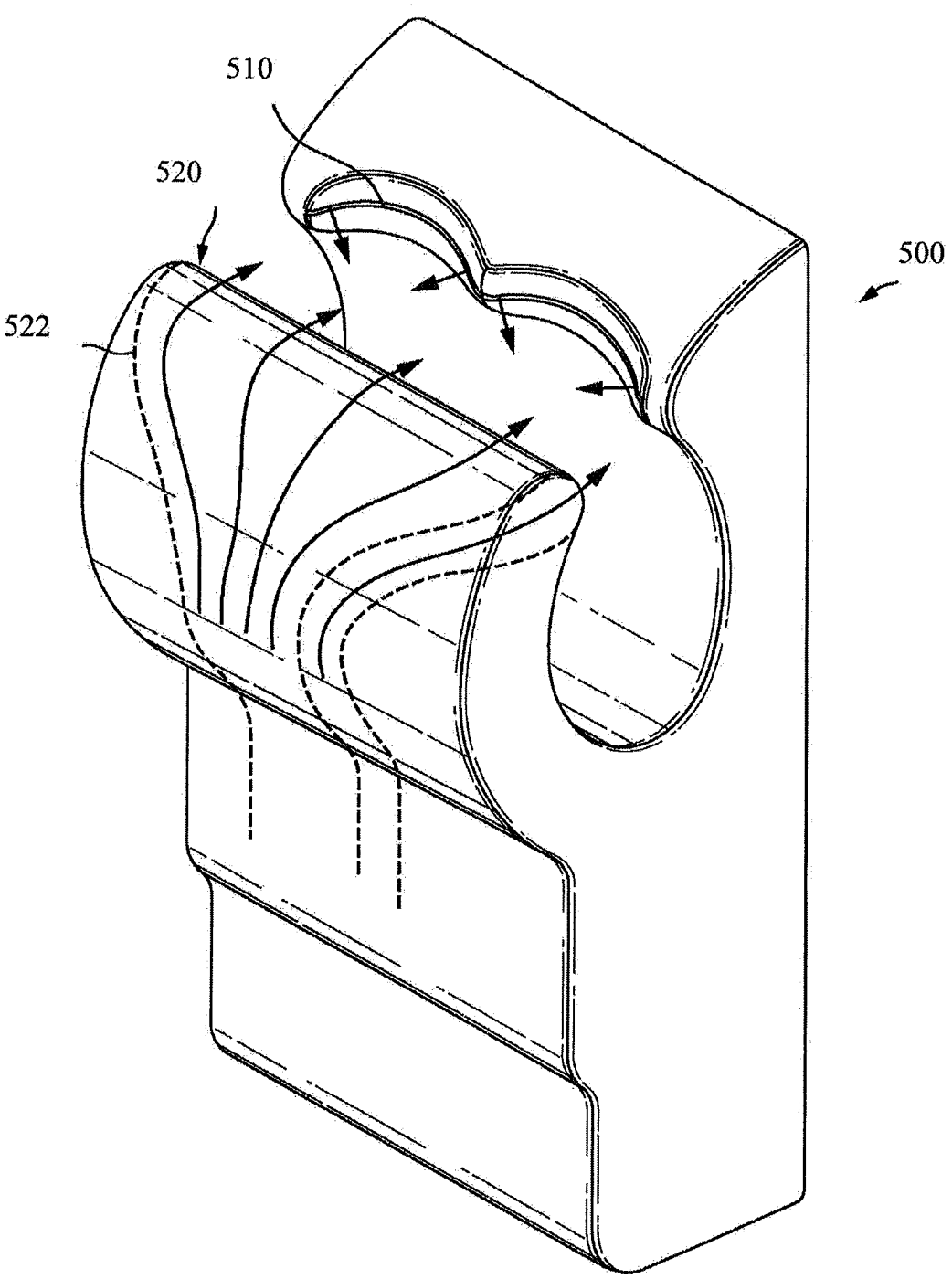
FIG. 9 illustrates a hand drier according to another embodiment of the present invention.

Referring to FIG. 9, the housing of a hand drier 500 according to an embodiment of the present invention has an inlet opening (not shown) and outlet openings 510, 520. The centrifugal impeller and its motor (not shown) are mounted within the outer housing. Under the driving of the motor, the centrifugal impeller establishes high speed airflows 522 which are discharged via their corresponding outlet openings.

Figure 10:
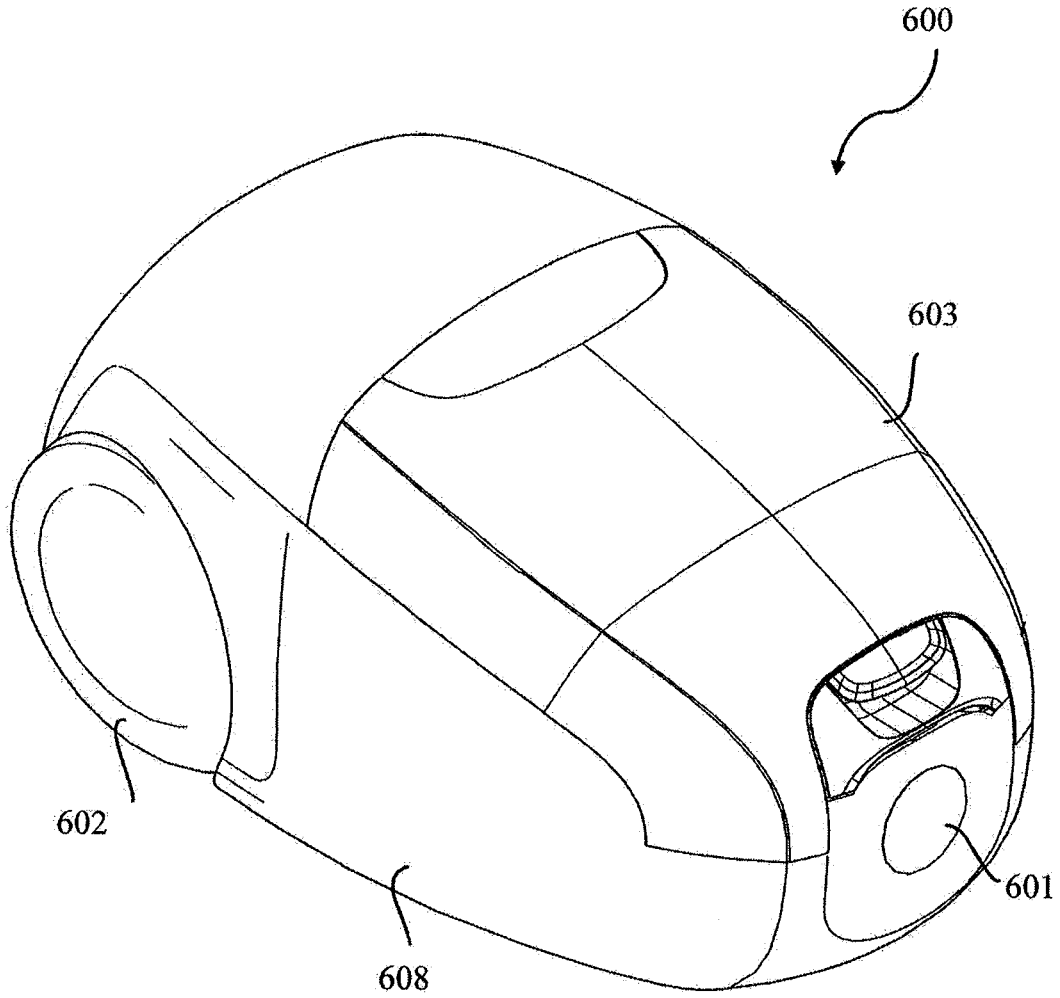
FIG. 10 illustrates a vacuum cleaner according to a further embodiment of the present invention.

Referring to FIG. 10, the housing of a vacuum cleaner according to an embodiment of the present invention includes a main body 608, a top cover 603 mounted to the main body 608, and wheels 602 mounted to a bottom side of the main body 608. The main body 608 has an inlet opening 601. The centrifugal impeller and its motor are mounted within a chamber defined by the main body 608 and the top cover 603. When driven by the motor, the centrifugal impeller establishes a low pressure or suction region inside the housing, such that outside dusts are drawn into the vacuum cleaner via the inlet opening 601.

It is to be understood that the centrifugal impeller and centrifugal blower provided by the present invention may also be used in other types of electrical appliances.

In the description and claims of the present application, each of the verbs "comprise", "include", "contain" and "have", and variations thereof, are used in an inclusive sense, to specify the presence of the stated item or feature but do not preclude the presence of additional items or features.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of example only, and various other modifications will be apparent to persons skilled in the field without departing from the scope of the invention as defined by the appended claims.

The invention claimed is:

1. A centrifugal impeller comprising:

a base plate comprising a plurality of blade mounting portions, each of the plurality of blade mounting portions of the base plate having a plurality of blade mounting holes;

a cover plate defining an air inlet, the cover plate and the base plate disposed opposite to each other with a predetermined distance formed there between, the cover plate comprising a plurality of blade mounting portions; and a blade assembly fixedly mounted between the base plate and the cover plate, the blade assembly comprising a plurality of curved blades arranged about the air inlet, each of the plurality of curved blades being fixed between a corresponding one of the plurality of blade mounting portions of the base plate and a corresponding one of the plurality of blade mounting portions of the cover plate, each of the plurality of curved blades having a first side close to the cover plate and a second side close to the base plate, cover plate mounting portions projecting from the first side and base plate mounting portions projecting from the second side;

wherein each of the plurality of blade mounting portions of the cover plate comprises a plurality of first mounting holes arranged outwardly from a region close to the air inlet, the plurality of first mounting holes having one of a regular polygon shape, elliptical shape and circular shape, and the cover plate mounting portions of each of the plurality of curved blades comprise a plurality of first mounting protrusions engaged with the plurality of first mounting holes, and wherein each of the plurality of blade mounting portions of the cover plate further comprises at least one second mounting hole arranged inwardly from a region close to an outer edge of the cover plate, the at least one second mounting hole having a shape of a rectangle, the shape of the at least one second mounting hole being different than the shape of each of the plurality of first mounting holes, the cover plate mounting portions of each of the plurality of curved blades further comprise at least one second mounting protrusion for engaging with the at least one second mounting hole.

2. The centrifugal impeller of claim 1, wherein the plurality of first mounting protrusions are round or square in shape.

3. The centrifugal impeller of claim 1, wherein each of the at least one second mounting protrusion has a shape of a rectangle, with a recess formed in a middle of an outer side of the rectangle.

4. The centrifugal impeller of claim 1, wherein the number of the plurality of first mounting protrusions of the cover plate mounting portions of each of the plurality of curved blades is three to ten times the number of the at least one second mounting protrusion of the cover plate mounting portions of each of the plurality of curved blades.

5. The centrifugal impeller of claim 4, wherein, for the cover plate mounting portions of each of the plurality of curved blades, a sum of the number of the plurality of first mounting protrusions and the number of the at least one second mounting protrusion is at least ten.

6. The centrifugal impeller of claim 1, wherein the base plate mounting portions of each of the plurality of comprise a plurality of mounting protrusions and each of the plurality of mounting protrusions of the base plate mounting portions of each of the plurality of curved blades has a shape of a rectangle, with a recess formed in a middle of an outer side of the rectangle.

7. The centrifugal impeller of claim 6, wherein each of the plurality of blade mounting holes of each of the plurality of blade mounting portions of the base plate has a shape of a rectangle.

8. The centrifugal impeller of claim 1, wherein the number of the plurality of blade mounting holes of each of the plurality of blade mounting portions of the base plate is less than the number of the plurality of first mounting holes of each of the plurality of blade mounting portions of the cover plate.

9. A blower comprising a motor, and the centrifugal impeller of claim 1, driven by the motor.

10. An electrical appliance comprising: an outer housing with an inlet opening and an outlet opening, and the blower of claim 9 mounted within the outer housing.

11. The appliance of claim 10, wherein the appliance is a hand drier or a vacuum cleaner.

* * * * *